US006000819A

United States Patent [19]

Graber et al.

[11] Patent Number: 6,000,819

[45] Date of Patent: Dec. 14, 1999

[54] WIDE AREA LIGHT FIXTURE FOR HAZARDOUS LOCATIONS

[75] Inventors: Warren S. Graber, Hoffman Estates; Horacio A. Baggio, Niles, both of Ill.

[73] Assignee: Woodhead Industries, Inc., Deerfield, Ill.

[21] Appl. No.: 09/046,297

[22] Filed: Mar. 23, 1998

Related U.S. Application Data

[60] Provisional application No. 60/041,483, Mar. 26, 1997.

[51] Int. Cl.[6] ..... F21V 15/02; F21V 21/00

[52] U.S. Cl. ..... 362/376; 362/263; 362/267; 362/396; 362/400

[58] Field of Search ..... 362/263, 265, 362/267, 376, 391, 396, 400, 362, 363, 382

[56] References Cited

U.S. PATENT DOCUMENTS

| | | | |
|---|---|---|---|
| 4,069,415 | 1/1978 | Dacal | 362/263 |
| 4,275,433 | 6/1981 | Caldwell | 362/22 |
| 5,594,304 | 1/1997 | Graber | 315/85 |

*Primary Examiner*—Sandra O'Shea
*Assistant Examiner*—Marshall Honeyman
*Attorney, Agent, or Firm*—Emrich & Dithmar

[57] ABSTRACT

A wide area lamp for use in hazardous locations includes a metal halide lamp excited by a ballast. The lamp is mounted within an explosion-proof transparent globe and metal lamp guard secured to a metal vault. The vault is divided into two compartments. One compartment houses a ballast for the lamp. That compartment is filled with a potting compound to eliminate any arcing in the high voltage excitation circuit. The other compartment is enclosed, but accessible for making necessary electrical connectors to a power feed cord.

11 Claims, 1 Drawing Sheet

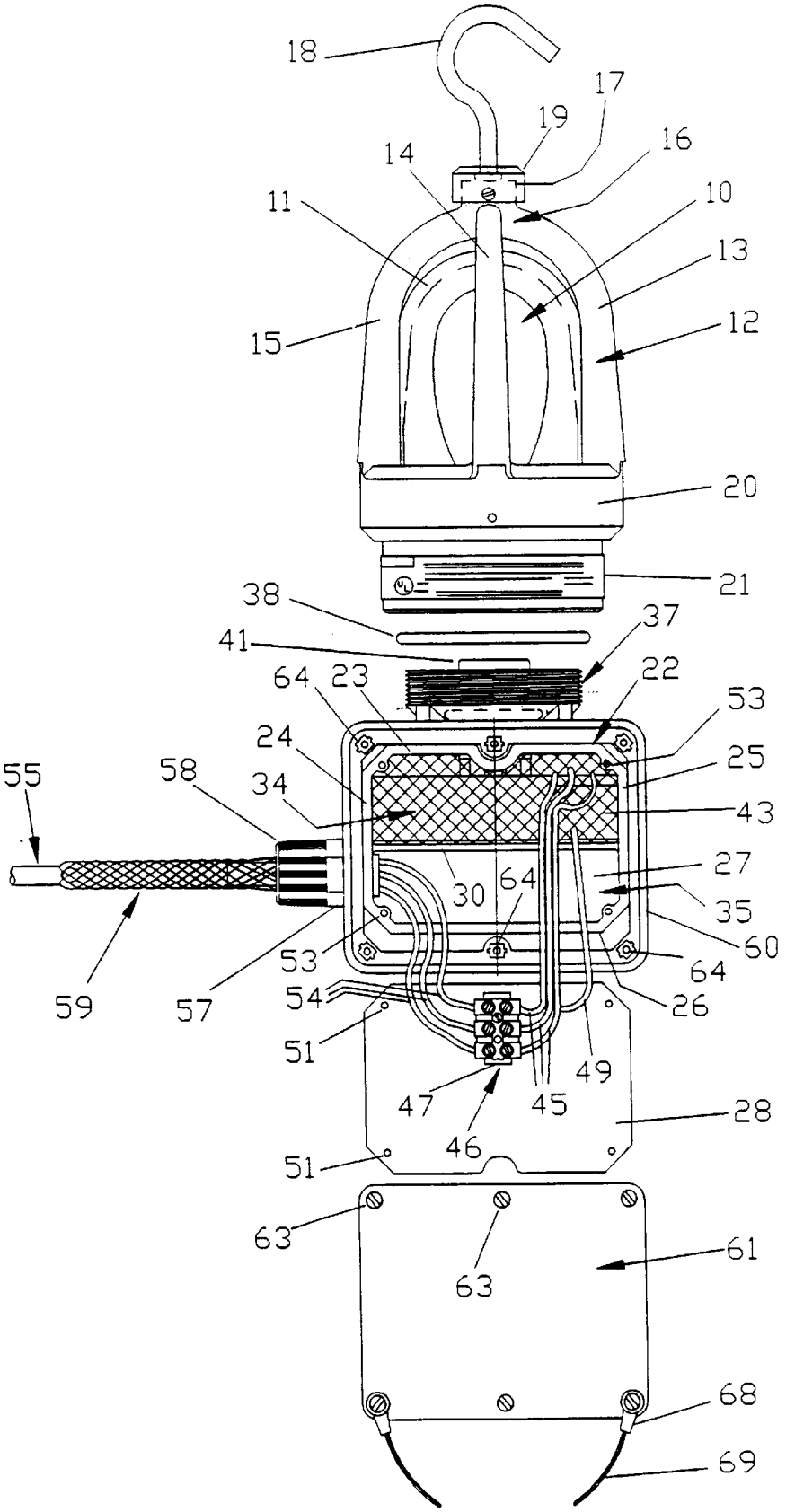
18
17
19
16
14
10
11
13
15
12
20
21
38
37
41
22
64
23
53
24
25
55
58
34
43
27
30
64
35
60
53
64
59
57
54
26
51
49
47
45
28
46
51
63
61
63
68
69

WIDE AREA LIGHT FIXTURE FOR HAZARDOUS LOCATIONS

RELATED APPLICATION

This application claims the benefit of the filing date of copending U.S. Provisional Application No. 60/041,483, filed Mar. 26, 1997.

FIELD OF THE INVENTION

The present invention relates to portable lighting fixtures; and in particular, it relates to a wide area light fixture for use in hazardous locations.

BACKGROUND OF THE INVENTION

In the past, it has been common to use incandescent lamps in wide area light fixtures for use in hazardous locations. One of the primary reasons favoring the use of incandescent lamps in such applications is that the only potential source for creating a spark is the terminal connections between the power cord and the light socket. The risk is minimal and the connections can be housed in a metal housing; and other precautions can be taken to minimize a potential hazardous occurrence. Moreover, by designing the interconnecting terminals to reduce the possibility of a spark, these designs have become more reliable through the years.

With the modem advent of improved light sources, particularly the introduction of metal halide and other high intensity discharge (i.e., HID) lamps, light production can be increased for the same electric power, but these lamps require use of ballasts and electronic excitation circuitry, increasing the risk of a spark. Thus, one cannot rely solely on the tried and reliable conventional simple terminal connections to reduce the hazard of a spark within the confines of a lamp fixture, and one must account for the possibility of arcing or sparks within the electronic circuitry energizing the lamp.

A portable hand lamp for hazardous locations using fluorescent lamps is disclosed in U.S. Pat. No. 5,594,304. While fluorescent lamps are suitable for hand lamp usage, they are not particularly suited for use as a "wide area" light—that is, one that can be hung in a location and transmit over a wide range area. Fluorescent lamps do not transmit as much light as HID lamps do for the same electrical power, and the light from fluorescent lamps is frequently focused by a reflector or the like, to concentrate the light to a localized area, not, for example, to light a room or large work area.

It is also important for commercial reasons to receive approval or listing with an independent testing organization, such as Underwriters Laboratories, for light fixtures for hazardous locations to assure potential users that safety precautions have been taken and to reduce insurance premiums for product liability. Heretofore it has been difficult, if not impossible, to achieve listing of portable HID light fixtures for hazardous locations with independent testing agencies because of the potential hazards.

SUMMARY OF THE INVENTION

The present invention is thus directed to a design for a wide area light fixture which is capable of using metal halide or other HID lamps as the light source in hazardous locations. HID lamps include, in addition to metal halide lamps, high pressure sodium lamps, low pressure sodium lamps and mercury vapor lamps. All require high voltage excitation. The invention includes an explosion-proof metal lamp guard and an explosion-proof globe having a metal halide lamp within.

The lamp guard includes a lower retainer ring which mounts to and seals with a threaded neck or ring forming the upper portion of a metal vault which forms a support base. The vault is divided into two compartments by a metal divider wall. In one compartment, the ballast and all connections to the lamp base are housed. The compartment is completely filled with epoxy, encasing all of the electrical components from which a spark could emanate, thereby eliminating this potential hazard. The other compartment houses a terminal block for connections between the power feed cord and the ballast. A removable metal door is secured to cover the entrances to both compartments of the vault. The vault is covered with a protective rubber covering, including a removable cover for the metal access wall of the vault.

Other features and advantages of the present invention will be apparent to persons skilled in the art from the following detailed description of a preferred embodiment accompanied by the accompanying drawing where identical reference numerals will refer to like parts in the various views.

BRIEF DESCRIPTION OF THE DRAWING

The drawing is a side view of a portable wide area electric light fixture for use in hazardous locations constructed according to the present invention, with portions of the fixture in exploded or separated relation for showing the interior thereof.

DETAILED DESCRIPTION OF THE ILLUSTRATED EMBODIMENT

Turning then to the drawing, reference numeral 10 includes a conventional metal halide (or other HID) lamp housed within an explosion-proof transparent globe 11. Surrounding the globe 11 is a metal lamp guard generally designated 12. The lamp guard 12 includes four equally spaced bars, three of which are shown and designated respectively 13, 14 and 15, the fourth one being opposite the bar 14 in the plane of the page of the drawing. All of the bars are joined at the top, in the area generally designated 16, to form a neck designated 17 which has an internally threaded portion to receive a hook 18, secured by a collar 19.

The bottom of the metal bars 13–15, as well as the one not shown in the drawing, are integrally formed with an annular base 20. At the bottom of the base, there is formed an internally threaded retainer ring 21. All of the components including the bars 13–15, the juncture 16, the annular base 20 and the retainer ring 21 are formed integrally by casting the same metal or alloy, thereby enhancing the strength of the unit and its resistance to tearing apart in the event of an explosion. The structure of the lamp guard 12 and the globe 11 are conventional.

Beneath the lamp guard, and secured to it in a matter to be described, is a metal vault generally designated 22. The vault 22 has a top wall 23, first and second sidewalls 24, 25, a bottom wall 26, a rear wall 27, all of which are integrally formed, and a removable front wall or cover 28.

A divider wall 30 is formed, in the illustrated embodiment, between intermediate locations of the two sidewalls 24, 25, and extending from the rear wall 27 to a location inboard of the front wall 28 sufficient to let wires past from above to below the divider wall when the front wall 28 is assembled to the vault. Thus, the divider wall 30, in cooperation with the other walls of the vault defines an upper chamber generally designated 34, and a lower chamber 35.

The top wall 23 of the vault 22 includes an externally threaded collar 37 which is threadedly received within the retainer ring 21 of the lamp guard. An O-ring 38 seals the interior of the globe 11 against the mouth of the threaded collar 37 to provide a protected, substantially gas-impervious interior within the globe. A lamp base 41 is mounted in the collar 37; and the top wall 23 of the vault includes an aperture in which lamp base 41 is received.

The ballast (i.e., the excitation circuit) for the lamp 10, as well as all connections between the lamp base 41 and the ballast, are first secured within the compartment 34, and then a potting compound (preferably epoxy), and illustrated by the cross-hatched body 43 completely fills the upper compartment, encasing the ballast and connections mentioned, and embedding lead-in wires 45 mounted to a terminal block generally designated 46, thus rendering the interior of the upper compartment 34 explosion-proof by isolating all high voltage connections and other potential sources of arcing from the atmosphere.

The terminal block 46 is mounted on a base 47 which is a part of the interior of the removable front wall 28 of the vault. When thus assembled, the base 47 has a height which is approximately the same as the distance from the lower surface of the divider wall 30 and the upper surface of the bottom wall 26 of the vault. Thus, when the front wall 28 is assembled to the side walls of the vault, the base 47 fits between the bottom wall and the divider wall 30 and braces the center of the divider wall for additional strength. To assemble the front wall 28 to the integral portion of the vault, the front wall is rotated about a horizontal axis in the plane of the page so that what appears as the bottom of the front wall in the drawing is actually the top of the front wall when it is assembled to the vault or lamp base. As mentioned, the forward edge of the divider wall 30 is spaced from the inner surface of the front wall 28 when the front wall is assembled to the vault by a distance sufficient to permit the wires 45 and 49 to pass between the divider wall and the front wall without crimping or possibly damaging the wires.

The wires 45 are the three power wires extending to the ballast, and a fourth wire is also included, the wire 49 being a ground wire from the circuitry embedded within the epoxy 43 to ground the removable front wall 28.

The front wall 28 has, in each comer, an aperture 51 for receiving a screw (not shown), which is received in a corresponding threaded bore 53 on the vault 22.

The three wires leading into the terminal block 46, and designated 54 in the drawing are a part of the input power cord generally designated 55. The power cord is assembled to the vault by means of a conventional male adaptor 57, preferably of a water-resistant type, and adapted to receive a threaded compression nut 58 of a conventional strain relief mesh 59 which grips the cord 55 and relieves strain on the connection.

The exterior of the vault 22 is provided, on the top, bottom, both sides and rear, with an integrally molded cover 60 of rubber. An insulating cover plate, which may be of plastic, and generally designated 61 is assembled to the rubberized sheath 60 by means of screws 63 which are received in six corresponding, aligned threaded clips 64 located respectively in each comer of the rubberized sheath 60 as well as in the centers of the top and bottom portions of the sheath 60. Support lugs 68 securing the ends of a wire 69 provide a means for hanging the fixture with the light illuminating a wide area, but in a downward direction.

Thus, the present invention includes a compartmentalized vault 22 having a first interior compartment housing the ballast and connections from the ballast to a lamp base for receiving the metal halide lamp. The compartment is completely filled with epoxy, encasing the ballast and all connections and lead-in wires. The compartment is further defined, on all sides, by metal walls, including portions of the exterior walls of the vault and the removable front wall of the vault, as well as the intermediate wall 30. The second compartment, namely the lower compartment 27 in the illustrated embodiment, is not filled with epoxy, but rather houses a terminal block 46 permitting connections between the input power cord and the ballast.

Persons skilled in the art will be able to appreciate that the structure described yields a highly reliable wide area lighting fixture with a metal halide or other suitable HID lamp, capable of being hung upright by the hook 18, or set on the base formed by the vault 22, or hung upside down by the wire 69. The structure also lends itself to stringing similar wide area lamp fixtures in an indefinite series by using a similar connecting structure such as the adaptor 57, compression nut 58 and strain relief mechanism on the right side of the vault as shown in the drawing, thereby permitting power to be fed to a similar explosionproof fixture at the other end of a continuing extension cord, similarly connected to an identical wide area light fixture.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. A light fixture for use in hazardous locations comprising:

a metal vault having a top, bottom and side walls;

said vault further having an inner wall dividing the interior of said vault into first and second compartments;

an explosion-proof transparent globe;

a high-intensity discharge light source within said globe;

a metal cage surrounding said globe and securing said globe to said top wall;

a terminal block mounted within said second compartment;

an excitation circuit for said light source located within said first compartment and including power feed wires extending from said first compartment and connected to said terminal block;

a potting compound encompassing said excitation circuit entirely and substantially filling said first compartment;

a power cord including conductors connected to said terminal block, said terminal block connecting associated wires of said power cord and said excitation circuit for supplying electrical power to energize said excitation circuit.

2. The apparatus of claim 1 wherein said light source is a metal halide lamp.

3. The apparatus of claim 1 wherein said light source is one of a low pressure sodium lamp, a high pressure sodium lamp, and a mercury vapor lamp.

4. The apparatus of claim 2 wherein said side walls of said vault comprise three generally flat metal side walls integrally formed with said top and bottom walls to form a metal vault in the form of a box, and a removable fourth metal side wall; and including fastener means for securing said fourth side wall to said top and bottom walls and to opposing ones of said three side walls to enclose said first and second compartments in a metal vault.

5. The apparatus of claim 4 further comprising a base member on said removable fourth side wall within said second compartment and extending between opposing surfaces of said intermediate wall and said bottom of said vault thereby to brace said intermediate wall.

6. The apparatus of claim 5 wherein said terminal block is mounted to said base member whereby said terminal block may be removed from the interior of said second compartment to facilitate access to said connections between said power cord and said excitation circuit conductors when said fourth side wall is removed from said vault.

7. The apparatus of claim 4 wherein said top wall of said vault includes a threaded ring and said metal lamp guard includes a threaded base for threaded engagement with said threaded ring, and a sealing O-ring within said threaded base for sealing with said threaded ring of said vault.

8. The apparatus of claim 7 wherein said lamp guard includes a hook at the top for hanging said apparatus upright.

9. The apparatus of claim 8 further comprising a flexible wire having first and second ends, said apparatus further comprising means for securing said first and second ends to said vault adjacent the bottom thereof, whereby said flexible wire may be used to hang said apparatus with said lamp below said vault for down lighting.

10. The apparatus of claim 3 further comprising a rubber outer sheath on the walls of said vault except for said fourth side wall; and further including a plastic cover for said fourth side wall removably secured to said rubber outer sheath whereby the exterior of said metal vault is provided with an insulated covering.

11. The apparatus of claim 10 further comprising a strain relief grip surrounding said power cord for securing said power cord to said vault to relieve strain on the connection of the wires of said power cord to said terminal vault.

* * * * *

UNITED STATES PATENT AND TRADEMARK OFFICE

CERTIFICATE OF CORRECTION

PATENT NO. : 6,000,819

DATED : December 14, 1999

INVENTOR(S) : Warren S. Graber and Horace A. Baggio

It is certified that error appears in the above-identified patent and that said Letters Patent is hereby corrected as shown below:

Column 1: line 26, delete "modem" and insert – modern –.

Column 3: line 61, delete "comer" and insert -- corner –.

Column 4: line 22, delete "explosionproof" and insert -- explosion-proof –.

Signed and Sealed this

Ninth Day of January, 2001

*Attest:*

Q. TODD DICKINSON

*Attesting Officer*

*Commissioner of Patents and Trademarks*